United States Patent [19]

Beebe

[11] Patent Number: 4,723,232

[45] Date of Patent: Feb. 2, 1988

[54] PENDULUM INDICATOR HOROLOGICAL DEVICE

[76] Inventor: William B. Beebe, 2832 Main St., Bethlehem, Pa. 18017

[21] Appl. No.: 7,680

[22] Filed: Jan. 27, 1987

[51] Int. Cl.[4] ..... G04B 19/00; G04B 17/02; G09F 19/00

[52] U.S. Cl. ..... 368/76; 368/179; 368/223; 40/426; 40/485

[58] Field of Search ..... 368/10, 76, 134–137, 368/165–166, 179–182, 223, 228; 40/426, 485; 185/29; 272/1, 85

[56] References Cited

U.S. PATENT DOCUMENTS

| | | | |
|---|---|---|---|
| 1,483,814 | 2/1974 | Juruick | 368/134 |
| 1,933,087 | 10/1933 | Battegat | 368/134 |
| 3,903,684 | 9/1975 | Wilson | 368/179 |
| 4,011,674 | 3/1977 | Jacobson | 40/426 |
| 4,121,416 | 10/1978 | Miemczyk | 368/88 |
| 4,417,725 | 10/1981 | Van Horn | 272/85 |
| 4,544,282 | 10/1985 | Giraldez | 368/165 |

*Primary Examiner*—Vit W. Miska
*Attorney, Agent, or Firm*—Charles A. Wilkinson

[57] ABSTRACT

A clock is provided with a pendulum suspended generally upwardly from the face of the clock and an electromagnet means is provided adjacent to the periphery of the face to catch and hold the pendulum bob momentarily to indicate at least one aspect of the time such as the minutes past the hour. Preferably the electromagnet is carried on a rotating support progressively around the peripheral portion of the clock face to alter the time indication. A lighted hand may be used to indicate the time in hours. In some embodiments the pendulum may swing outwardly beyond the face of the clock.

35 Claims, 11 Drawing Figures

PENDULUM INDICATOR HOROLOGICAL DEVICE

CROSS REFERENCES TO RELATED APPLICATIONS

This application is one of four related applications concurrently filed by the present inventor, the related applications being for a Magnetically Controlled Arrhythmic Pendulum Device, a Pendulum Type Decorative and Time Indicating Device, and a Decorative Horological Device, the latter application being a design application.

BACKGROUND OF THE INVENTION

1. Field of the Invention

This invention is generally directed to pendulum type devices and is more particularly directed to pendulum type horological devices and more particularly still to a horological device wherein a pendulum is used to indicate the time or to partially indicate the time and more particularly still in which the path of oscillations of the pendulum are caused to deviate or rotate to the side above a clock face in broad imitation of the hands of a clock.

2. Description of the Prior Art

It is well known that the oscillations of the so-called gravity pendulum, as opposed to a torsion pendulum, has a period dependent upon the length (l) of the suspension of the pendulum bob and the acceleration of a freely falling body (g) due to gravity in accordance with the well known equation:

$$T = 2\pi\sqrt{\frac{l}{g}}$$

Since acceleration in a gravity field is the same for all objects, disregarding air resistance and the like, all pendulums having the same suspension length will swing with the same harmonic motion along a vertically oriented curved path, i.e. with the same simple periodic motion, and, if started together with small amplitude, single pendulums of different masses will swing in synchronism. It was Huggins who in the seventeenth century first adapted the pendulum to regulate a mechanism for keeping time and thereby originated the first accurate clock mechanism. The use of a pendulum, therefore, as a time keeping device is of fairly ancient vintage. One well known example is the use of a pendulum in a grandfather's clock. In the grandfather's clock the pendulum is used not only to regulate the clock mechanism, but is also used as a decorative feature, the regular movement of which is attractive to the observer.

With the arrival of modern technology the pendulum has no longer been as useful as a time keeping mechanism. However, its popularity as a decorative feature has continued and dummy pendulums having no time regulating or horological function have continued to be used in clocks. In such clocks the pendulum merely mimics the normal utilitarian function of a pendulum while providing an eye attracting movement as a decorative feature of the horological device. Exemplary disclosures of such devices may be found in the following U.S. patents:

U.S. Pat. No. 2,722,097 issued Nov. 1, 1955 to J. Lefrand discloses a conical pendulum alternating current clock wherein the pendulum motion both drives and regulates the clock mechanism. In the Lefrand device the clock is controlled by the frequency of a pendulum formed of electrically conductive material and caused to swing in a conical path by means of a rotating or oscillating electric field, as in an induction motor.

U.S. Pat. No. 2,995,005 issued Aug. 8, 1961 to R. L. Boyles describes a swinging pendulum clock, "the pendulum motion of which is utilized for other than timekeeping purposes and does not control the operation of the clock mechanism."

U.S. Pat. No. 3,762,154 issued Oct. 2, 1973 to C. B. Petrides is directed to a simulated pendulum clock wherein the "pendulum is functionally separated from a timekeeping movement for driving the hands of the clock."

U.S. Pat. No. 3,762,155 issued Oct. 2, 1973 to C. B. Marble is also directed to a pendulum clock wherein the pendulum is functionally separated from the timekeeping movement which drives the hands of the clock. The '155 patent is particularly directed to a pendulum arm with an upper pendulum drive arm having a permanent magnet positioned adjacent to an electromagnetic movement for driving the pendulum and a lower pendulum arm removably connected to the upper pendulum arm.

U.S. Pat. No. 3,903,684 issued Sept. 9, 1975 to A. Wilson discloses a pendulum type time or interval keeper in which the swing of a pendulum per se indicates elapsed periods of time. The pendulum includes a magnetic means which interacts with a second magnetic means mounted on the base in a keeper. The magnetic means is not used for adding energization to the swings of the pendulum or determining the position to which the pendulum swings, but serves instead to operate the keeper at the conclusion of movement.

U.S. Pat. No. 3,924,401 issued Dec. 9, 1975 to E. Heim discloses the provision of a dummy torsion pendulum (as opposed to an oscillating pendulum) under a clock mechanism.

U.S. Pat. No. 4,121,416 issued Oct. 24, 1978 to C. Niemczyk discloses a dummy oscillating pendulum periodically energized by solenoid coil means energized momentarily during the pendulum oscillations by contact switch means.

U.S. Pat. No. 4,203,282 issued May 20, 1980 to B. Radzun is broadly similar to the dummy torsion arrangement shown in U.S. Pat. No. 3,924,401 to Heim described above.

U.S. Pat. No. 4,468,132 issued Aug. 28, 1984 to N. Nakamura discloses a swinging body clock in which oscillation of the body of the clock as well as an attached pendulum is effected by magnetic means hidden within or behind the clock case.

While the above described devices have provided a varied repertory of clock type devices in which a pendulum is used other than as a time regulating means, but is used instead as an attention attracting or decorative device, none makes use of the pendulum as a time indicating device as contrasted with a time regulating or time measuring device.

The use of a pendulum as a time indicating means is described and claimed in the present applicant's concurrently filed application entitled Pendulum Type Decorative and Time Indicating Device referred to above, in which several embodiments of clocks or horological devices are disclosed, particularly where a time sequence representation is moved linearly or curvilinearly, i.e. rotated, past a transversely oscillating pendulum which serves to indicate the current time in the time sequence representation. The passage of a movable pendulum past a stationary time sequence representation is also disclosed. However, it has been noted that difficulty with maintaining an arcuately precessing oscillation is likely to occur due to vibration and the altering positions of the energizing electromagnets result in unpredictable deviations in the trajectories of the pendulum oscillations.

The present inventor has discovered that the above noted difficulties with pendulum type time indicating devices in which the pendulum trajectory changes and particularly where it rotates over a time sequence representation, for example, over the usual type of round clock face, can be obviated if certain particulars and parameters are adhered to as more especially described hereinafter.

It is an object of this invention, therefore, to provide a unique and attractive timekeeping device utilizing a pendulum which not only oscillates transversely across a time sequence representation to indicate current time, but also moves transversely of its oscillation in coordination with changes in time while maintaining a precise oscillation path.

It is a further object of this invention to provide a timekeeping device wherein a pendulum functions as a time indicator means the oscillation path of which permutates or precesses in a rotary pattern adjacent to or over the time sequence representation means.

It is another object of this invention to provide a timekeeping device which is driven either electrically or mechanically and incorporates a pendulum as at least part of the time indicating means, said pendulum having both a periodic oscillation and a transverse time sequence following movement.

It is a still further object of this invention to provide a timekeeping or horological device in which a pendulum serves as a novel and attractive time indicating means having a combined motion which has at least two distinct components of motion at substantial right angles to each other.

It is a still further object of this invention to provide a timekeeping or horological device in which an oscillating pendulum serves as a replacement or a partial replacement for the usual rotating hands on a clock face.

SUMMARY OF THE INVENTION

The instant invention accomplishes the above objects by providing a timekeeping device having a pendulum bob adapted to swing freely from a fixed point above the clock face in an oscillatory fashion. A clock mechanism for driving the hour and minute indicator means is provided. Magnetic means mounted on one of the indicator means is provided to attract the swinging pendulum, hold it at least momentarily at a time indicating position over the clock face and then release it to continue its free oscillating motion. Each back and forth oscillation or series of oscillations between captures of the pendulum by the electromagnet therefore traverses a completely new trajectory and no unpredictable or uncontrolled elliptical oscillations are engendered. In the preferred embodiment the indicator means to which the pendulum is attracted and held is the minute indicator means. The magnetic means is adapted to be energized intermittently through a timer. In a variation of the device of the invention the pendulum serves as the only time indicating device as it swings over a large clock face.

DESCRIPTION OF THE PREFERRED EMBODIMENTS

Pendulum type clocks have been popular pieces of furniture in homes, offices and places of business for many years. The so-called grandfather's clock is an outstanding example of this type of clock. However, in these previous pendulum clocks the function of the pendulum, as an integral time regulating portion of the clock mechanism, has been to regulate the advancement of the hour, minute and second hands by virtue of the back and forth swinging, or oscillating, motion of the pendulum. More recently with the popular use of electric energy to drive clock mechanisms, the pendulum, no longer needed to regulate the advancement of the clock mechanism, has been added to simulate a pendulum clock and produce an attractive ornamental piece. The timekeeping function of the clock is provided by a mechanism associated with an electric or spring loaded motor that drives the clock mechanism and also provides a separate drive for the pendulum. In contrast, in the present invention a pendulum is used not merely as an ornamental device, but is also used at least partially as a time indicating device or one of the time indicating devices, or, alternatively, at least as an aid in indicating the time. In such use the oscillating pendulum is caused to advance about the face of the clock or about a time indicating diagram, preferably in the general form of a clock face, in synchronism with the measured passage of time.

Figure 1:
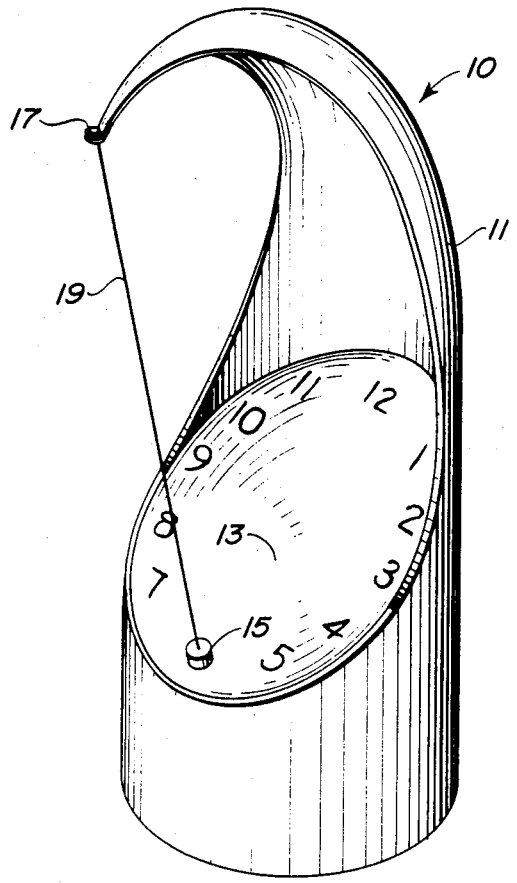
FIG. 1 is an isometric view of one embodiment of the horological device of the invention.
Figure 2:
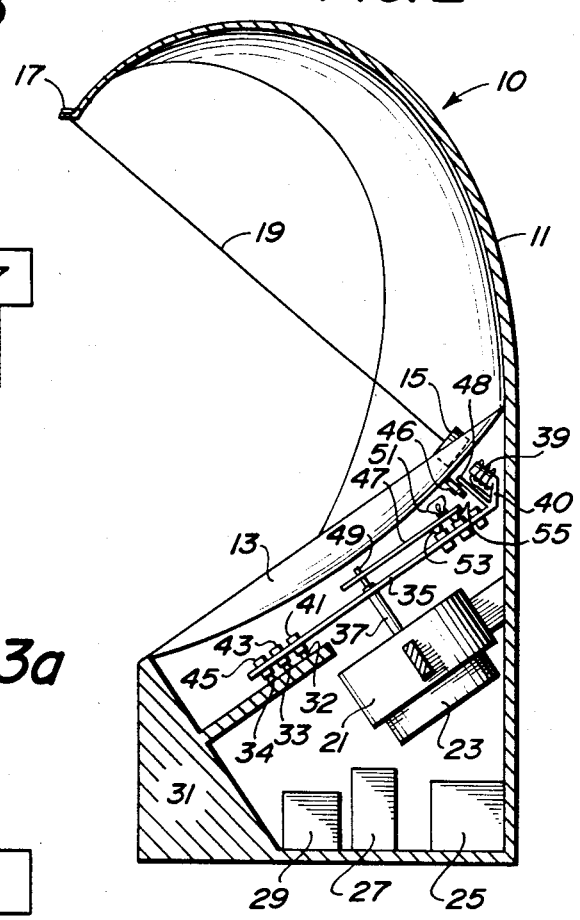
FIG 2 is a sectional side view of the timekeeping device shown in FIG. 1.

Referring now to the drawings and particularly to FIGS. 1 and 2 for a detailed description of the invention, the timekeeping device 10 is seen to comprise generally a casing 11, an inclined slightly concave clock face 13 set at an average angle tangent to the face of approximately 35 degrees from the vertical, a pendulum bob 15 and a fixed point or suspension point 17 from which the pendulum bob 15 is suspended by a flexible but nonelastic cord or wire 19. By nonelastic is meant not significantly elongatable by the force of gravity as the bob traverses the bottom portion of its oscillations. The flexible material could also be replaced by a rigid rod. The lower portion of the casing is depicted as round, but could, of course, be any other shape and while the clock face is oval to fit in the base at an angle it also could be any other acceptable shape.

The clock casing 11 as shown in FIG. 2 houses a conventional electric clock mechanism 31, an electric motor 23, a power source 25 such as a battery or transformer connected to an outside power source, a timer 27 and a relay 29. A support shelf 31 mounts three electrical brushes 32, 33 and 34 which are conventionally connected to power source 25 to supply electrical power to a rotatable power disk 35. The power disc 35 is mounted on the rotational axis of the hollow shaft 37 of the clock mechanism 21. The power disc 35 replaces in the embodiment of the invention shown in FIGS. 1 and 2 the usual minute hand in a conventional clock and is thus arranged to rotate once every hour. At one point on the outer periphery of the power disc is rigidly mounted an electromagnet 39 supported on a curved arm 40 which serves in the embodiment shown as the minute hand of the clock, as will presently be explained. As seen in more detail in FIGS. 4 and 5 the power disk 35 has three bands 41, 43 and 45 of electrically conductive material embedded in the power disk, which bands may be denoted respectively as the inner E.C. (electroconductive) band, the middle E.C. band, and the outer E.C. band. Leads 59 and 61 from electromagnet 39 are respectively connected at 58 and 60 to the middle E.C. band 43 and the outer E.C. band 45 so the electromagnet receives its energization from these bands. As noted, the electrical brushes 32, 33 and 34 mounted upon the support shelf 31 provide power to the several electroconductive bands of the power disk 35. This is accomplished by contact of the brushes respectively with the underside of electroconductive bands 41, 43 and 45. As shown more especially in FIG. 5 the leads 59 and 61 may extend through an opening in the arm 40 and the lead 59 may extend further through an insulated orifice 44 in the E.C. band 45 before connecting with the E.C. band 43. A small bearing wheel or roller 46 is preferably provided on an arm 48 extending from the arm 40 of the electromagnet 39 in a position so that it bears against the bottom of the clock face 13 for a purpose which will presently appear. The power disk 35 is shown for convenience in FIGS. 4 and 5 with the lateral dimensions and spacing somewhat distorted.

An hour indicator, or hour hand, 47 of the clock or timekeeping device 10 is mounted on a central shaft 49 which extends through the hollow shaft 37 upon which the power disk 35 is mounted. At the outer end of the hour hand 47 there is mounted an illuminated means 51 such as an incandescent lamp, a light emitting diode (LED), liquid crystal display device (LCD) or the like, which can be seen by an observer through the preferably translucent clock face 13. The illuminated means 51 receives energizing current via electrical brushes 53 and 55 on the underside of the hour hand 47 in position such that they establish electrical contact with the inner E.C. band 41 and middle E.C. band 43 respectively as the hour hand 47 rotates respective to the power disk 35.

Figure 4:
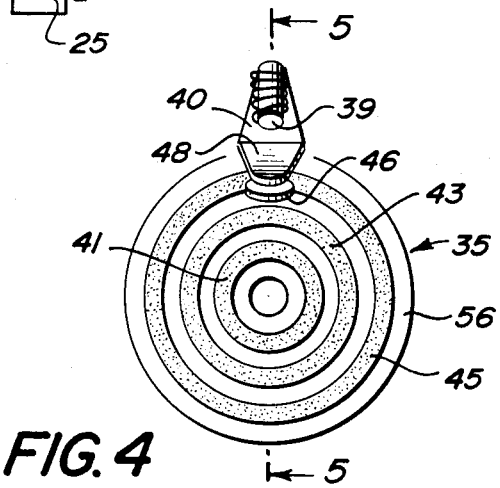
FIG. 4 is a plan view of the power disc of the apparatus shown in FIG. 2.
Figure 5:
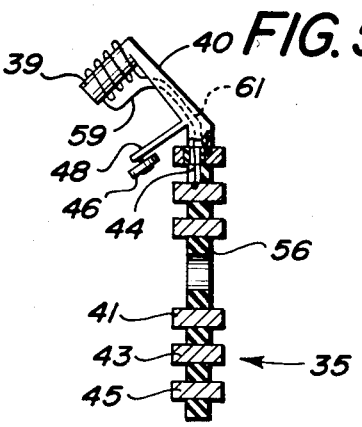
FIG. 5 is a section through the power disc of FIG. 4 taken on line 5—5 of FIG. 4.

FIGS. 4 and 5 show in additional detail how the power disk 35 is constructed. The disk may be constructed in various manners, but, as shown in the figures, is essentially a disk of plastic or the like, non-conductive material 56 with the electrically conductive bands 41, 43 and 45 embedded in the body of the disk. Alternatively, the disk could be of solid material with concentric electroconductive rings deposited on both its upper and lower surfaces with a further electrical connection between the corresponding rings on opposite sides of the disk. Other constructions are possible.

It will be noted in FIG. 2 that the clock face 13, which, as noted above, is preferably of a translucent material so that the illuminated means 51 may show through, has a concave form which allows the pendulum bob 15 to remain as close as possible to the surface of the clock face as the pendulum swings across the surface. This in turn allows the electromagnet 39 to be maintained as close to the path of the pendulum bob as possible as the electromagnet progresses around the clock face just under the bottom surface of the clock face 13. As indicated above, the average angle tangent to the concave clock face is preferably, as shown, about 35 degrees with respect to horizontal as a reference, but various other angles of inclination could be used.

Figure 3:
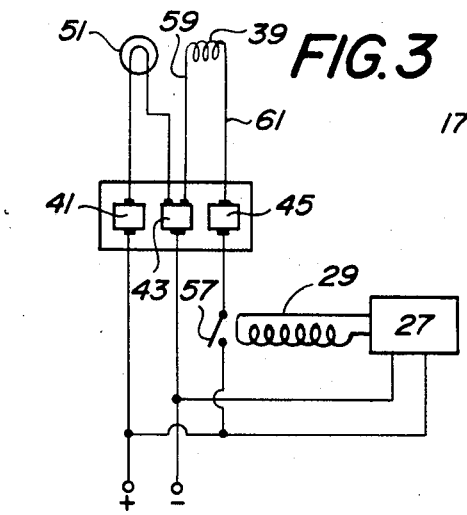
FIG. 3 is a schematic wiring diagram for the device of FIGS. 1 and 2.
Figure 3A:
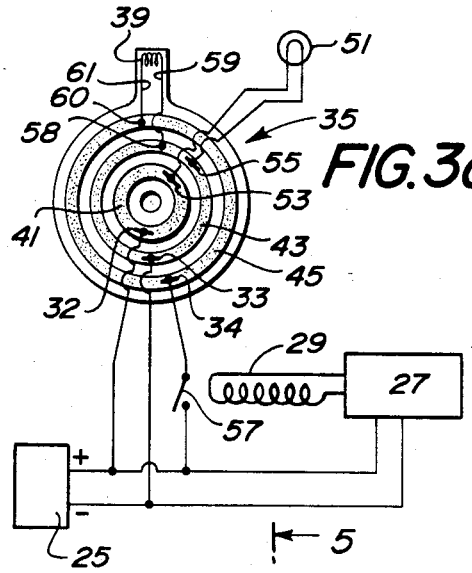
FIG. 3*a* is a semi-schematic wiring diagram for device of FIGS. 1 and 2 showing more particularly how the wiring is related to the rotating parts of the apparatus.

FIG. 3 is a schematic and FIG. 3*a* is a semi-schematic wiring diagram showing the essential circuitry for operation of the pendulum clock shown in FIGS. 1 and 2. In FIG. 3 and particularly as shown in FIG. 3*a*, the power supply, which may be either a D.C. or A.C. power supply 25, is connected via brushes 32, 33 and 34 with electroconductive bands 41, 43 and 45. If an A.C. power supply is used, a suitable rectifier will be necessary to convert to D.C. for use with the electromagnet. The bands 41 and 43 are directly connected to the power supply 25 via the brushes 32 and 33 while the third band 45 is connected to the power supply 25 through an interrupt switch 57 which is operated by relay 29 which is periodically activated by timer 27. When the timer 27 activates relay 29 it in turn closes switch 57 and current is passed via electrical brush 34 to the outer E.C. band 45. Leads 59 and 61 from the ends of the coil of electromagnet 39 (which is shown only as the solenoid coil portion of the electromagnet in FIG. 3*a*) are directly or rigidly connected at points 58 and 60 to E.C. bands 43 and 45 at the other end so that when the switch 57 is closed the electromagnet 39, which is carried around on an extension of the power disc 35, just below the clock face 13, is activated or energized. At the same time the illuminated means or electric lamp 51 is continuously activated through brushes 53 and 55 which are in electrical contact with E.C. bands 41 and 43. The E.C. band 43, i.e. the middle E.C. band, is the return line in each case for current both from the electromagnet 39 and from the lamp 51 to the power source 25 to complete the circuit.

The power disc 35 is secured at its center as explained above on the minute drive stem 37 of the clock mechanism 21. Both the hour and the minute indicator means of the clock mechanism may be either electrically or mechanically driven. Since the electromagnet requires an electrical power source, however, it will usually be convenient to use the same power source to operate an electric rather than a mechanical motor, for example a spring wound motor. The power disc may be formed of any strong, rigid electrically non-conductive material in which are embedded the three circular bands 41, 43 and 45 each with its center congruent with the rotational axis of power disc 35. The bands are electrically insulated from each other and present an exposed face on both the top and the bottom of the power disc and are electrically conductive through the thickness of the disk. As indicated above, the bands could be comprised of electroconductive deposits or metallic rings on opposite sides of the power disk in electrical communication with each other.

The electromagnet 39 should be directly fixed to the outer periphery of the power disk 35 or mounted or carried as shown on a rigid arm extending from the edge of the power disk in such manner as to maintain the magnetic axis of the coil of the magnet tangent to the spherical arc described by the clock face 12, which face should not only be translucent to light, but should not be magnetizable or electroconductive so it will not interfere with the magnetic field of the magnet. As will be seen in the figures, as the power disk rotates, the attached electromagnet 39, which can be referred to as the "minute coil", moves around the circumference of the clock dial following a path immediately behind the clock face.

The pendulum bob 15, which may be a magnet or a suitable piece of magnetically permeable material, is dependent from the fixed point 17 located on a line passing through the rotational axis of the clock mechanism along the axes of the shafts 37 and 49. The suspension 19 of the pendulum bob 15 has a length sufficient to allow the pendulum bob 15 to swing freely, but close to the clock face, in an arc such that the bob 15 nearly brushes the clock face 13, which takes the form of a spherical segment. The concave spherical segment of the clock face has a slightly greater radius than the length of the pendulum. In the preferred arrangement shown in FIGS. 1 and 2 the spherical segment of the clock face intersects equally on all sides of a plane inclined about 35 degrees from horizontal. The clock face 13 may be provided with the usual Arabic, Roman or other numerals or designations of hours and/or minutes which do not physically protrude from the face of the clock sufficiently to interfere with the smooth oscillation or swing of the pendulum 15.

The electromagnet 39 travels about the edge of the clock face with the rotating power disc at a given rate, normally one circuit of the face every sixty minutes. The electromagnet is of sufficient power to take complete control of the pendulum bob, i.e. to catch and hold the pendulum bob when such bob swings to within the operable or effective magnetic field of the electromagnet. The parameters of the electromagnet may vary depending upon the exact construction and dimensions of the clock structure in general and the size, weight and construction of the pendulum bob as well as the power available. In each instance, however, it is necessary in accordance with the invention that the electromagnet and its arrangement be such that the electromagnet will take complete control of the pendulum bob 15 and hold the pendulum in an extended position on its suspension 19 and substantially stationary until the electromagnet cuts off, at which time the pendulum bob will be released and will swing away from the electromagnet across the clock face with a new and separate trajectory independent of its previous trajectories. Since each new oscillation has a new trajectory and movement completely separate from the prior movement of the pendulum bob, it will be found that the pendulum will oscillate transversely completely separately from all previous oscillations and no elliptical or other unpredictable oscillations will be induced. The accuracy of the pendulum oscillations as a time indicating means is thus maintained.

The timing mechanism within the timer 27 can be any suitable mechanism which periodically cuts off and restores power through the action of the associated circuitry to the electromagnet. Thus, the timer can be one of a number of commercially available timers manually adjustable to switch electric current on and off regularly for "on periods" of from approximately 0.5 seconds to five or more minutes. The timer's "off" period should last for a minimum of approximately 0.25 seconds and does not need to be adjustable. The exact period during which the electromagnet is off will depend in part upon the size of the clock face and the length of the pendulum. Preferably both the on and the off periods are programmable or adjusable by the user.

In operation of the device of the invention, the depended weight or pendulum bob 15 is caught and held by the energized electromagnet 39 at a point on the clock face directly in front of the location of the electromagnet 39 behind the clock face. Thus, the momentary halting of the pendulum bob indicates or points to a specific location on the clock face which indicates minutes when interpreted in relation to the position of the hour indicator, and the time of day with respect to segments of the hour is indicated. As explained previously, the momentary halting of the pendulum bob also allows the individual oscillations of the pendulum to be isolated from each other. Such isolation prevents the lateral deflection of the pendulum as a result of the electromagnet or magnetic field progressing about the clock face with the passage of time to keep from resulting in elliptical and/or other unpredictable trajectories of the pendulum. Any such deviant trajectories would interfere with the accuracy of the pendulum as a time indicator.

When the timer 27 cuts off power to the electromagnet 39 through the appropriate circuits, collapsing the magnetic field of the electromagnet, the dependent pendulum bob 15 is released to swing outward in an arc having as a constant radius the distance to the fixed suspension point 17. In accordance with normal pendulum motion the pendulum bob will swing along an arc to a point opposite its starting point and slightly below the horizontal plane of such starting point and will then swing back to another point slightly below the point of original release. During the time of the swing the electromagnet 39 will have moved a slight distance along its circuit about the clock face and the timer 27 will have restored power to the electromagnet whereupon, at the end of the pendulum's return swing, the electromagnet will again catch and hold the pendulum bob, but at a position slightly removed from its original position, the new position corresponding to the passage of time during the one complete oscillation of the pendulum. This movement, comprised of swings and temporary halts of the pendulum bob over the portion of the clock face representing the current time, continues from swing to swing as the pendulum makes complete circuits of the clock face. Normally, the pendulum will make one complete circuit of the clock face in one hour.

It will be recognized that the pendulum bob 15 when released from a position at the top of the clock face as illustrated in FIG. 2 will make a large swing across the clock face and then out beyond the clock face before reversing direction and returning again to a point closely adjacent to the top of the previous swing near the top of the clock face where it is again caught by the electromagnet. However, as the electromagnet 39 progresses down the side of the clock face with the passage of time the swing of the pendulum will become less pronounced until at the bottom of the clock face the swing of the pendulum reaches its shortest oscillation. It will also be recognized that for this reason it is necessary for the fixed support point 17 to be located in a horizontal direction to the side of the clock face as a whole, else at some point the pendulum bob might be caught by the electromagnet 39 and held directly under the fixed support point and when released would not resume its swing or oscillations. In other words, the support point must be positioned above and to the side of the clock face.

The operation of the device has been described above in connection with an electromagnet sufficiently powerful to catch and hold the pendulum bob, if not after the completion of every oscillation of the pendulum, at least after the completion of every few oscillations, usually not more than every two or three oscillations. While it might be thought that an oscillation pattern could be worked out in which the electromagnet is merely strong enough to add sufficient energy to the pendulum bob to return it essentially to its original height when combined with the natural momentum of the pendulum bob, but not sufficiently powerful to actually halt and hold the pendulum bob in a position suspended over the electromagnet, such an arrangement will not be found to be satisfactory on a long term basis.

If the electromagnet were only strong enough to add lost energy to the pendulum bob, or, in other words, to replace the frictional and other energy losses of the pendulum oscillation on every swing, the pendulum, instead of assuming a straight back and forth oscillation above the relevant time indices, would, because of the intervening circumferential movement of the electromagnet, be thrown into a series of unpredictable elliptical oscillations. Such elliptical oscillations would quickly cause the electromagnet to lose all control over the pendulum and its usefulness as a time indicating means would be lost. Not only would the oscillations of the pendulum no longer be an accurate reflection of the current time because they no longer passed consecutively over consecutive time designations, but the elliptical oscillations might soon carry the pendulum bob beyond the influence of the electromagnet. It is necessary for the pendulum bob to return to a position about the same distance from the electromagnet just before each activation of the magnet if uniform motion is to be maintained. On the other hand, if the electromagnet takes control of the pendulum bob at the end of each oscillation or at the end of every few oscillations and does not influence the pendulum bob in between, and the pendulum is momentarily at least, held substantially stationary at the end of one oscillation or swing, the pendulum will begin the next oscillation or series of oscillations from, so to speak, a standing start and will swing in a straight line away from the holding point and back again, assuming, of course, that the holding point is not in a direct line between the suspension point and the center of gravity. Each series of oscillations in this manner becomes essentially independent or, in other words, the oscillation of the pendulum becomes in effect a series of independent oscillations with different trajectories. The period of the individual trajectories remains the same in accordance with the normal physics of pendulums, but the average oscillation period for the series of oscillations as a whole will have a greater value.

Figure 6:
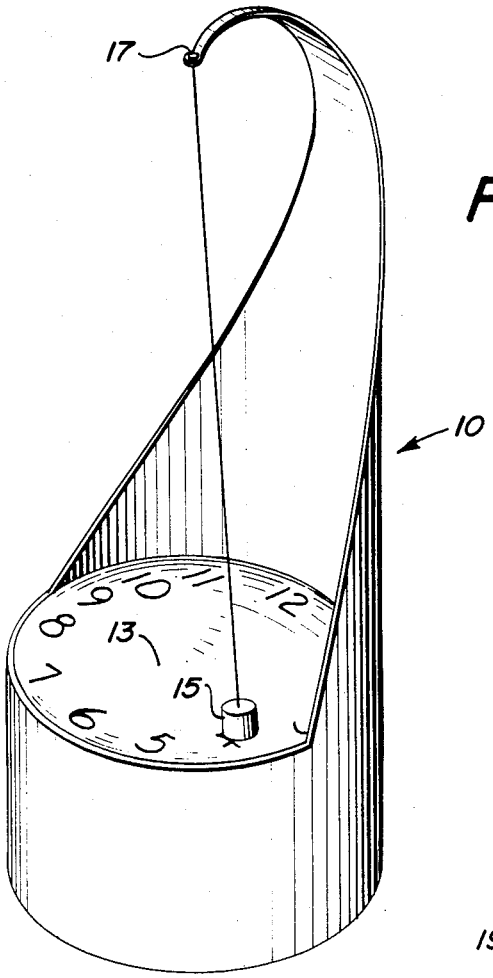
FIG. 6 is an isometric view of a further embodiment of the invention.
Figure 7:
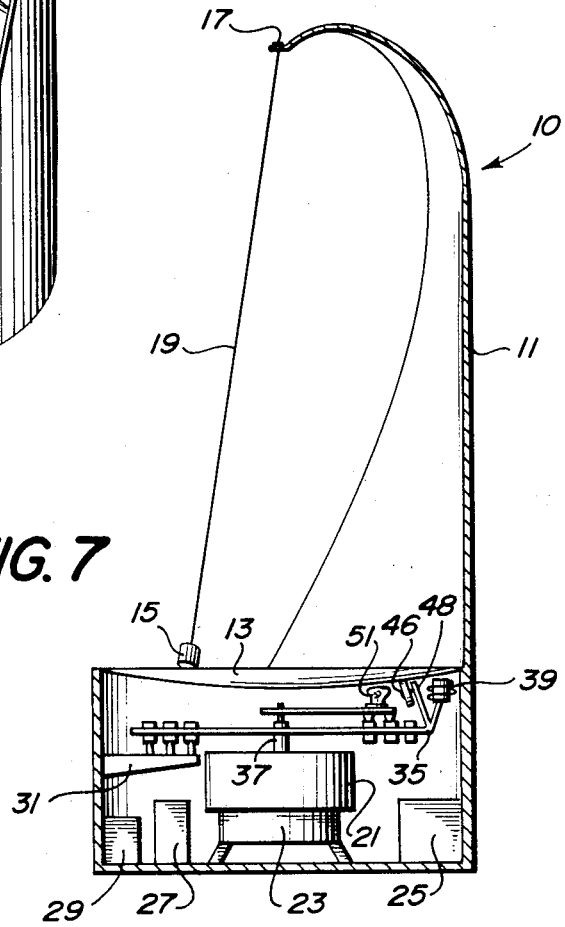
FIG. 7 is a sectional side view of the embodiment shown in FIG. 6.

In some instances it may not be desirable for the pendulum to swing beyond the face of the clock where it may be snagged by other nearby objects or the like. FIGS. 6 and 7 show an isometric view and elevational section respectively of an embodiment of the invention wherein the pendulum bob does not oscillate beyond the confines of the clock face. FIGS. 6 and 7 are analogous to FIGS. 1 and 2 and like parts are identified with like reference numerals. The internal mechanism of the two embodiments are substantially the same as will be seen in FIG. 7, the principal difference between the two devices being that the clock face instead of being inclined generally at an angle such as 35 degrees to horizontal as in the prior figures is instead substantially horizontal, disregarding the curvature of the face. The fixed point 17 above the clock face from which the pendulum is suspended is also positioned directly over the center of the clock face, although still in line with the axis of the rotating power disk 35 and the shafts 37 and 49 of the clock mechanism 21.

In the embodiment of the invention shown in FIGS. 6 and 7 the pendulum does not swing beyond the clock face, but is instead attracted as in the previously described embodiment to a position directly over the electromagnet 39 while the electromagnet is activated and then upon deactivation of the electromagnet 39 swings to the other side of the clock face 13. Since the pendulum swings from side to side of the clock face, there might be confusion as to which minute designation the pendulum is indicating, i.e. the minutes indicated over the position of the electromagnet, which electromagnet is, of course, hidden from the view of the observer by the translucent clock face, or the time in minutes directly across the clock face from the electromagnet position. However, since the electromagnet retains the pendulum above it for a short time before releasing it, as is necessary as explained above to maintain uniform straight oscillations of the pendulum, it will soon become evident to the observer, if it is not already known, that the time indicated is the point where the pendulum bob stops momentarily and not the opposite point on the clock face. While the embodiment of the invention shown in FIGS. 6 and 7 is, therefore, not as eye catching, it may be more practical and acceptable in some environments due to the pendulum bob remaining within the confines of the clock face.

It is, of course, possible also to provide a light on the power disk adjacent to the electromagnet 39 to indicate the time in minutes in conjunction with the indication provided by the swing of the pendulum bob 15. The light may be wired in series with the electromagnet so it will light when the electromagnet is activated. The activation of the light when the pendulum bob hesitates over the electromagnet will remove all doubt as to what indication of time in minutes is intended.

It is also possible in accordance with the invention to use the pendulum to indicate the time in hours rather than in minutes and to indicate the time in minutes by the use of an illuminated indicator such as an electric lamp carried on a minute hand of the clock. Normally, however, it is more pleasing and attractive to indicate the minutes rather than the hours by means of the pendulum arrangement of the invention, because of the more rapid change in the minute position.

It is also possible in accordance with the invention to have the pendulum indicate both the hours and the minutes at the same time. This can conveniently be done by using a large clock face with the spaces between the hours marked off into minutes or other time periods such as five minute time periods, tenths of an hour, or the like. In such a device there is only a single time indicating means, i.e the arrangement is essentially a clock with only an hour hand and as in a clock with only an hour hand the face is usually on a larger scale with fractional hour representations or even with individual minute divisions so the time in less than hour segments can be more easily determined.

Figure 10:
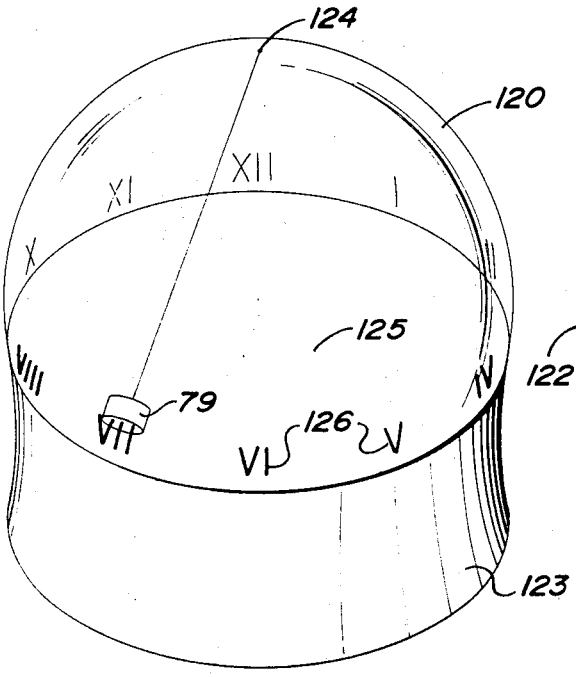
FIG. 10 is an isometric view of the embodiment of the invention of FIGS. 8 and 9.
Figure 8:
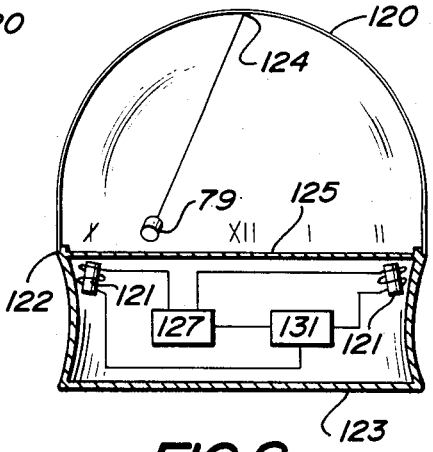
FIG. 8 is a sectional side view of a further embodiment of the invention.
Figure 9:
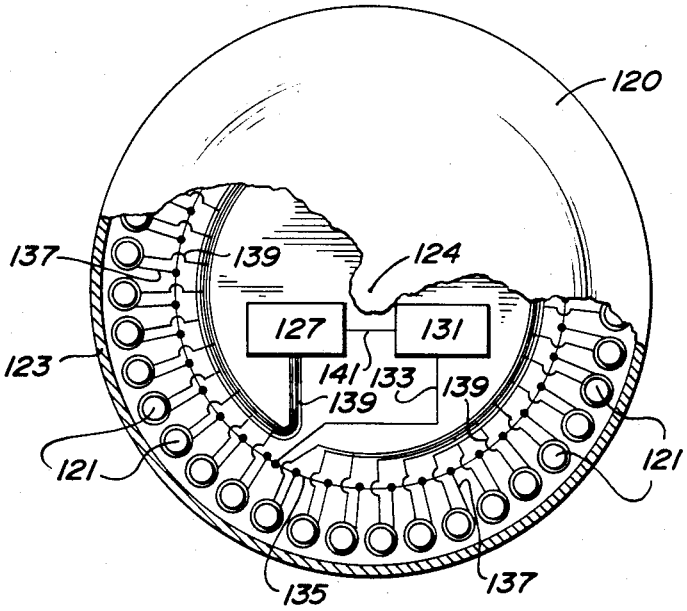
FIG. 9 is a partially broken away plan view of the embodiment of FIG. 8.

A further possible embodiment of the invention is shown schematically in FIGS. 8, 9 and 10 which show in a sectional elevation in FIG. 8 and also in a partly broken away plan view 9, and in an isometric view in FIG. 10 an arrangement where instead of a moving electromagnet there are a series of closely adjacent stationary electromagnets 121 positioned around the inside periphery of a clock 123 just under the clock face or clock casing cover 125. The pendulum support in this case is comprised of a removable transparent glass or plastic dome 120 which rests upon a lip 122 of the clock casing 123. A pendulum suspension means 124 from which the pendulum depends is provided at the apex of the transparent dome 120. The dome serves the further function of protection both of the pendulum and the clock face. As shown in FIG. 10 in isometric projection, the outside of the dome may incorporate time designations 126, in this case in Roman numeral form. Such time designations may be in addition to or in place of the more usual time designations on the face of the clock. If the time designations 126 are on the transparent dome 120 the lower edge of the dome may be considered to be the clock face, but if the time designations are on the clock casing cover then such casing cover will be the clock face.

Energization of the electromagnets 121 is controlled by a conventional electronic timer 127 which activates each electromagnet in turn in a timed progression about the periphery of the clock face so that the pendulum bob 79 as it oscillates back and forth is progressively biased to the side in rough unison with the progressive change in time. As shown in FIG. 9, electrical power is supplied by power source 131 via lead 133 to a power matrix ring 135 from which leads 137 connect to each electromagnet 121. The return circuit for each electromagnet 121 proceeds through separate leads 139 to the combined relay and timer 127 and thence back via lead 141 to power source 131. The embodiment of the invention shown in FIGS. 8 and 9 is advantageous in that it may have a minimum of moving parts or even no moving parts other than the pendulum to get out of adjustment. It may in fact rely entirely upon relatively cheap conventional solid state electronic components for operation. The clock arrangement of FIGS. 8 and 9 has the disadvantage, however, of requiring a large number of separate electromagnets and fairly complicated wiring, depending upon the accuracy required, and usually will not be practical for providing accurate timekeeping because of the discontinuous positions of the electromagnets. The arrangement is, in other words, inherently a large interval digital arrangement rather than a smooth analog arrangement. Furthermore, a compromise must be made as to the power and size of the individual electromagnets 121 not only because of cost, but because each electromagnet must be large and powerful enough to gain control of the pendulum bob within its electromagnetic field, but also small enough so the distance between the centers of the electromagnets is not too great. The electromagnets should not be too far apart, not only because large distances cause a very discontinuous movement with poor time accuracy, but also because the electromagnet will only have a certain range within which its magnetic field is sufficient to take control of the movement of the pendulum bob.

A simple but easily adaptable mechanical timing circuit suitable for coordinating and timing energization of the series of electromagnets 39 is illustrated in FIG. 6 of U.S. Pat. No. 1,938,417 to Curran for progressively illuminating the face of a clock. The electromagnets of the present invention can be easily substituted for the incandescent lamp fixtures shown in the circuit of the patent. The relative length of the energization of the electromagnet and/or the number of electromagnets can be easily accommodated by increasing the number and/or varying the length of the individual contact segments 45 of the patented timer. Normally the contact arm may make a complete circle each hour, but this obviously may also be varied. It will be obvious that various other known timing arrangements, some considerably more sophisticated than that shown, could be substituted for the timer shown in the patent to perform an equivalent function or job. Among such sophisticated timing devices would be state of the art solid state or integrated circuit electronic timers. A similar mechanical timer arrangement to that shown in U.S. Pat. No. 1,938,417 could be used in a suitably modified form as the timer shown in FIGS. 2 and 7. Suitable modifications will be evident to those skilled in the art of mechanical timing.

As has been explained, a number of variations in construction, arrangement and operation of the pendulum clock of the invention can be made and the pendulum can equally well be either the primary time indicating device or only an auxiliary time indicating device. For example, the clock might provide normal hour, minute and even second hands on its face to indicate the time and still make an auxiliary use of an oscillating pendulum to indicate or attract attention of an observer to one of the seconds, minutes or hours. Likewise the clock face could have a digital display through the usual LED display or the like of the time, either at progressive points around the periphery of the clock, or at some arbitrary position on the clock face and still make use of a pendulum oscillating back and forth across the face of the clock while progressing slowly around the periphery indicating the approximate time.

While the invention, furthermore, has been illustrated with respect to horological devices incorporating a full circular, i.e. 360 degree, clock face, which is usually the most attractive and convenient embodiment, it could also be applied to horological devices incorporating merely arcuate time indicia having various curvatures, which could in some cases substantially approach or even reach a straight linear configuration as well as a curvilinear configuration. In other words, the invention is applicable generally to those cases where the pendulum oscillates transversely of the spacially extended time indicia and also progressively moves laterally with respect to its transverse oscillations, or, using other terminology, longitudinally along the linear or curvilinear extent of the time indicia.

Variations in operation or movement of the pendulum indicator may also be used in accordance with the invention. For example, not only may the pendulum be arranged to oscillate either within or partially within and without the clock face, but the pendulum may also be arranged to swing or oscillate back and forth several times between re-energization and/or momentary halting over the electromagnet at the end of an oscillation. This will, of course, require adjustment of the timer activating the electromagnet so it will be activated only after the proper interval of time for several oscillations to take place. A feedback type control system which senses the number of oscillations or merely the passage of the pendulum, for example, by interference with a light beam or by magnetic interference could also be used to activate the electromagnet.

The relationship of the electromagnet or electromagnets and the swing of the pendulum bob can also be varied. For example, the pendulum bob may at the end of its swing be positioned near the electromagnet or housing for the electromagnet but it may also be arranged to touch the electromagnet or an intermediate housing or a stop, in which case the electromagnet itself or the intermediate casing structure or stop will define the extreme end of the swing of the pendulum. The pendulum bob and the electromagnet or intermediate casing, stop, or other fixed means may also be designed to make an audible click or the like as they contact each other at the end of the pendulum swing, which click may also be used as a measure of time. In any case the pendulum bob after contacting the fixed means should be held against said fixed means at least momentarily in order to commence the next oscillation anew. A somewhat stronger magnetic field may also be necessary, particularly if the magnet itself does not serve as the fixed stop and said stop and and pendulum bob upon contact emit an audible click or the like, in order to prevent the pendulum from bouncing off the fixed stop with a possibly undesired trajectory.

In each of the embodiments shown in the accompanying Figures and described above it is necessary at some point to initiate the motion of the pendulum. This is in most cases easily done since the power need only be turned on by operation of an appropriate switch, which it has not been thought necessary in most cases to illustrate, by plugging in the power source or the like. The appropriate timing means will then begin energizing the electromagnets in appropriate order. At this point the pendulum may be manually biased to the side toward one or the other of the electromagnets sufficiently such that the effective magnetic field of the magnet when activated in turn will be sufficient to take control of the pendulum bob. The apparatus will thereafter continue to operate in its predetermined sequence. The pendulum bob can be biased toward the electromagnet by physically grasping the pendulum and thrusting it toward the magnet or by tilting the casing or housing of the apparatus so that the effects of gravity draw the pendulum bob toward an appropriate electromagnet. Of course, a mechanical biasing means or device of suitable design could also be incorporated into the apparatus to aid in initial deviation of the pendulum. Once operation is initiated the device of the invention will continue to cycle through its predetermined program as long as sufficient power is supplied.

It will also be evident that while the invention has been shown and described in the form of a base from which a pendulum support extends and in which the electromagnets are housed, various other arrangements could be used. For example, a separate support could be used and in a large installation the pendulum could even be supported from an existing overhead structure such as the ceiling of a room in which the base incorporating the timing mechanism and the electromagnets is contained. The support for the pendulum, therefore, may only be associated with rather than directly physically connected to, the base. It will also be evident that the base rather than comprising a physically separate structure could comprise an addition to as well a portion of an already existing structure such as, for example, a table or a counter or even the floor of a room in which the electromagnets and timing mechanism could be inset.

While it will be understood that the invention has been described in considerable detail in connection with the above drawings and explanation of the various embodiments illustrated, the invention is not to be limited to the particulars of any such embodiments, but is meant to be construed broadly with reference to the language of the appended claims so as to provide the broadest possible interpretation of such claims in view of the prior art and thereby to effectively encompass the intended scope of the invention.

I claim:

1. A time keeping device comprising:

(a) a surface incorporating time sequence indicia, (b) a pendulum bob suspended from a support positioned upwardly of the indicia incorporating surface, said pendulum bob being formed from a magnetizable material, (c) electromagnetic means positioned adjacent a peripheral portion of said time sequence indicia incorporating surface in a position to influence the end of an oscillation of said pendulum, (d) means to effectively move the electromagnetic field of said electromagnetic means along said indicia incorporating surface, and (e) means to activate the electromagnetic means when the pendulum means is near one end of its oscillation and substantially adjacent to a time indicia and to deactivate said electromagnetic means after a predetermined period to allow the pendulum bob to continue its oscillation.

2. A time keeping device in accordance with claim 1 in which the electromagnetic field moves as a result of movement of a transport means upon which the electromagnetic means is carried.

3. A time keeping device in accordance with claim 1 in which the electromagnetic field moves as a result of sequential activation of a series of electromagnetic means positioned adjacent the time sequence indicia.

4. A time keeping device in accordance with claim 1 in which the time sequence indicia are curvilinearly extended.

5. A time keeping device in accordance with claim 4 in which the time sequence indicia extend substantially 360 degrees.

6. A time keeping device in accordance with claim 5 in which the oscillating pendulum is the only indicating means.

7. A time keeping device in accordance with claim 5 in which the oscillating pendulum is one of two or more indicating means.

8. A time keeping device in accordance with claim 5 in which the oscillating pendulum is auxiliary to the other time indicating means.

9. A time keeping device in accordance with claim 7 wherein there are separate hour and minute indicating means, one of which is the pendulum.

10. A time keeping device in accordance with claim 9 wherein the pendulum is the minute indicating device.

11. A time keeping device in accordance with claim 10 additionally comprising an illuminated means on the hour indicating means and the indicia carrying surface is positioned over the hour indicating means and the indicia carrying surface is at least translucent to allow passage of light from said illuminated means.

12. A time keeping device comprising:

(a) a time indicating clock face, (b) a clock mechanism having hour indicator means and minute indicator means, (c) a pendulum bob suspended from a fixed point located above said mechanism, said pendulum bob adapted to swing freely from said fixed point in an oscillatory fashion, (d) means to rotate said hour indicating means and said minute indicator means adjacent to said time indicating clock face, and (e) magnetic means to attract said pendulum bob to a position over one of said indicator means, to hold said pendulum bob in said position and to release said pendulum bob from said position.

13. The device of claim 12 additionally comprising:

(f) a casing for enclosing said clock mechanism and said magnetic means and having an inclined time indicating face which is a concave spherical segment with a radius at least somewhat greater than the length of said pendulum.

14. The device of claim 13 wherein said hour indicator means includes an illuminated portion, said magnetic means is attached to said minute indicator means and said time indicating face is at least translucent to allow passage of light.

15. The device of claim 14 wherein said minute indicator means comprises a power disc rotatably mounted on the rotational axis of said clock mechanism, said magnetic means comprised of an electromagnet mounted on said power disc, and said power disc is electrically connected to a power source through a timer and a relay.

16. The device of claim 15 wherein the timer is adapted to energize the relay intermittently.

17. The device according to claim 16 wherein the clock mechanism is driven mechanically.

18. The clock device according to claim 16 wherein the clock mechanism is driven by an electric motor.

19. A time keeping device comprising:

(a) clock mechanism having a clock face, hour indicator means and minute indicator means, (b) means to drive said hour indicator means and said minute indicator means with respect to said clock face, (c) a pendulum bob suspended from a point fixed above said clock mechanism and adapted to swing freely from said fixed point in an arc which nearly brushes the surface of the clock face, and (d) magnetic means to repeatedly and in sequence 1. attract said pendulum bob to one of the said indicator means, 2. capture said pendulum bob within the magnetic field created about said magnetic means, 3. hold said pendulum in a position in front of the clock face at a point substantially in front of said indicator means, and 4. release said pendulum bob from said position.

20. The device of claim 19 wherein the clock face is positioned at an angle acute from the horizontal.

21. The device of claim 20 wherein the pendulum bob may swing beyond the confines of the clock face freely during the normal operation.

22. The device of claim 21 wherein the arrangement and construction is such that the pendulum oscillates in a substantially back and forth pattern relative to the normal observation angle of an observer of the clock face from directly in front of said clock face.

23. The device of claim 21 wherein the suspension point for the pendulum is positioned above and to one side of the clock face.

24. The device of claim 22 wherein the magnetic means is rotated about an inclined axis and the suspension point of the pendulum is positioned along an extension of said axis above and to one side of said clock face.

25. A method of indicating the progression of time with a pendulum comprising:

(a) moving an electromagnet in a path adjacent to a linearly extended time indicia at a predetermined rate, (b) oscillating a magneticaly permeable pendulum bob substantially transversely of said extended time indicia, (c) periodically activating said electromagnet from a power source to attract said electromagnet to a position adjacent to said time indicia, (d) maintaining activation of said electromagnet for a predetermined time period and with a strength sufficient to stabilize said pendulum bob in a substantially motionless position adjacent said electromagnet at least momentarily, and (e) deactivating said electromagnet after stabilization of said pendulum bob to allow the pendulum bob to swing away from said electromagnet in a substantially straight trajectory reoriented with respect to said time indicia with respect to its previous oscillatory trajectory.

26. A method of indicating the progression of time with a pendulum in accordance with claim 25, wherein the reorientation of the straight trajectory of the pendulum after stabilization is radially with respect to a curvilinearly extended time indicia.

27. A method of indicating the progression of time with a pendulum in accordance with claim 26, wherein the radial reorientation of the pendulum after each stabilization is effected substantially over 360 degrees.

28. A method of indicating the progression of time with a pendulum in accordance with claim 27 wherein the pendulum bob is caused to traverse a shorter trajectory in some radial orientations of its oscillations than in others.

29. A method of indicating the progression of time with a pendulum in accordance with claim 28 wherein the pendulum bob is caused to oscillate in a generally back and forth pattern relative to the normal observation angle of an rver of the curved tire indica.

30. A time keeping device comprising:

(a) a surface incorporating spacially extended time indicia, (b) a pendulum bob suspended from a point fixed above the spacially extended time indicia surfaces, (c) electromagnetic means to:

(i) attract said pendulum bob toward the time indicia, (ii) capture said pendulum bob within the magnetic field created about said electromagnetic means, (iii) hold said pendulum in a position adjacent to an indica of said extended indicia, (iv) release said pendulum bob from said position, (d) repeat step (c) repeatedly and in sequence at serially spaced locations along the time indicia.

31. A time keeping device in accordance with claim 30 wherein the time indicia is curvilinearly extended.

32. A time keeping device in accordance with claim 31 wherein the electromagnetic means is transported along the extended time indicia.

33. A time keeping device in accordance with claim 31 wherein the electromagnetic means is comprised of a plurality of separate electromagnetic devices arranged along the extended time indicia and coordinated to be activated substantially in sequence.

34. A time keeping device in accordance with claim 30 wherein the electromagnetic means is transported along the extended time indicia.

35. A time keeping device in accordance with claim 30 wherein the electromagnetic means is comprised of a plurality of separate electromagnetic devices arranged along the extended time indicia and coordinated to be activated substantially in sequence.

* * * * *

UNITED STATES PATENT AND TRADEMARK OFFICE

CERTIFICATE OF CORRECTION

PATENT NO. : 4,723,232

DATED : February 2, 1988

INVENTOR(S) : William B. Beebe

It is certified that error appears in the above-identified patent and that said Letters Patent is hereby corrected as shown below:

Column 16, line 56, the last line of claim 29 "rver" should read -- observer --.

Same line, "tire" should read -- time --.

Signed and Sealed this

Seventeenth Day of January, 1989

*Attest:*

*Attesting Officer*

DONALD J. QUIGG

*Commissioner of Patents and Trademarks*